US009650227B2

(12) United States Patent
Kalliomäki

(10) Patent No.: US 9,650,227 B2
(45) Date of Patent: May 16, 2017

(54) ELEVATOR

(71) Applicant: KONE Corporation, Helsinki (FI)

(72) Inventor: Jaakko Kalliomäki, Vantaa (FI)

(73) Assignee: KONE CORPORATION, Helsinki (FI)

( * ) Notice: Subject to any disclaimer, the term of this patent is extended or adjusted under 35 U.S.C. 154(b) by 169 days.

(21) Appl. No.: 14/554,196

(22) Filed: Nov. 26, 2014

(65) Prior Publication Data

US 2015/0166305 A1 Jun. 18, 2015

(30) Foreign Application Priority Data

Dec. 17, 2013 (EP) ..... 13197634

(51) Int. Cl.
*B66B 5/12* (2006.01)
*B66B 7/06* (2006.01)

(52) U.S. Cl.
CPC ..... *B66B 5/125* (2013.01); *B66B 7/062* (2013.01); *B66B 7/064* (2013.01)

(58) Field of Classification Search
CPC ..... B66B 5/125; B66B 7/062; B66B 7/064
USPC ..... 187/391
See application file for complete search history.

(56) References Cited

U.S. PATENT DOCUMENTS 3,672,214 A * 6/1972 Yasuda ..... G01L 5/04 73/862.46
4,467,895 A * 8/1984 Smith ..... B66B 1/3476 187/391
6,123,176 A 9/2000 O'Donnell et al.
6,364,063 B1 * 4/2002 Aulanko ..... B66B 11/008 187/251

(Continued)

FOREIGN PATENT DOCUMENTS

JP 55-11913 U 1/1980
WO WO 2009/090299 A1 7/2009

*Primary Examiner* — Michael Riegelman
(74) *Attorney, Agent, or Firm* — Birch, Stewart, Kolasch & Birch, LLP

(57) ABSTRACT

An elevator includes a car, a counterweight, a rotatable drive member, and one or more suspension ropes interconnecting the car and the counterweight and passing over the rotatable drive member. Each of the suspension rope(s) has a first rope section on the first side of the drive member and a second rope section on the second side of the drive member, the first section(s) of the rope(s) being connected to the car to suspend the car. The second section(s) of the rope(s) are connected to the counterweight to suspend the counterweight. Drive machinery controls rotation of the drive member. The elevator includes a rope tension sensor mounted on the counterweight and arranged to sense tension of the second section(s) of the rope(s). The rope(s) include(s) electrically conducting member(s) extending continuously along the length of the rope(s) forming an electrically conducting connection between the car and coun- (Continued)

terweight. The rope tension sensor is functionally connected with the drive machinery via said electrically conducting connection between the car and counterweight such that reduced rope tension of the second rope section(s) sensed by the rope tension sensor triggers the drive machinery to brake rotation of the drive member and/or to stop rotating the drive member.

20 Claims, 5 Drawing Sheets

(56) References Cited

U.S. PATENT DOCUMENTS

| | | | | |
|---|---|---|---|---|
| 2002/0000347 | A1* | 1/2002 | Baranda | B66B 7/06 187/254 |
| 2003/0011483 | A1* | 1/2003 | Lamb | B66B 7/1223 340/664 |
| 2003/0121729 | A1* | 7/2003 | Heinz | B66B 7/062 187/254 |
| 2004/0026177 | A1 | 2/2004 | Ayano et al. | |
| 2011/0000746 | A1* | 1/2011 | Pelto-Huikko | B66B 7/062 187/254 |
| 2011/0253484 | A1* | 10/2011 | Berner | B66B 5/125 187/279 |
| 2014/0182974 | A1* | 7/2014 | Puranen | B66B 5/0018 187/247 |
| 2015/0344267 | A1* | 12/2015 | Valjus | B66B 5/0037 187/254 |
| 2016/0046463 | A1* | 2/2016 | Saarelainen | B66B 7/1215 187/254 |

* cited by examiner

ELEVATOR

FIELD OF THE INVENTION

The invention relates to an elevator, in particular to an elevator which is meant for transporting passengers and/or goods.

BACKGROUND OF THE INVENTION

In elevators, the counterweight and the car are interconnected with suspension ropes, which pass over a rotatable drive member. The rotatable drive member is usually in the form of a drive wheel. It is typically rotated with an electric motor. The rotatable drive member engages the ropes generally by friction and/or positive locking, whereby it can, by its rotation, make the ropes run from one side of the rotatable drive member to the other side thereof. The counterweight forms a force on the ropes on the counterweight-side of the rotatable drive member acting on opposite direction than the corresponding forces caused by the car on the car-side of the rotatable drive member. In some elevators the engagement between the ropes and the drive member is strong enough to support the whole weight of the car even without the effect of the counterweight. This may be the case for example if the frictional engagement between the ropes and the rotatable drive member is very firm or if the elevator uses toothed belts as the suspension ropes. An engagement this firm may be dangerous if for some reason the effect of the counterweight is lost. For example, if the counterweight is stuck immovable in the hoistway this causes a risk that subsequent lifting of the car upwards may result in a drop of the car when the engagement is ultimately is lost (stalling). In case the counterweight gets immovable, from thereon the rotation of the drive member to the car-upwards-direction will move the car upwards and wind slack rope on the counterweight-side of the drive member. Should the engagement in such a slack rope-situation be lost, the car would drop. In most elevators the counterweight and the car are furthermore interconnected with a compensation roping passing around a diverting wheel located in the lower parts of the hoistway. The compensation roping is generally enough to prevent the above described dangerous situation from developing. Elevators having a firm engagement between the drive member and the ropes and designed without a compensation roping passing around a diverting wheel located in the lower parts of the hoistway, on the other hand, are particularly vulnerable to dangerous stalling in such slack rope-situations. A problem with prior art elevators has been a lack of simple configuration for reacting quickly to counterweight-related safety issues.

In addition to stalling, also other kinds of counterweight-related safety issues may exist. Such issues may be for instance the danger of derailment of the counterweight and the activation of the safety gear of the counterweight. In prior art, counterweight-related safety issues have not been solved in a simple way.

BRIEF DESCRIPTION OF THE INVENTION

The object of the invention is, inter alia, to solve one or more of the previously described drawbacks as well as to achieve advantages discussed later in the description of the invention.

An object of the invention is to introduce a new elevator, which is improved in terms of its safety and simplicity. An object is, in particular, to provide a new elevator where an unsafe situation related to functioning of the counterweight, in particular a stalling situation, is quickly noticed and reacted to. An object is to provide an elevator with configuration that is simple and efficient in providing said quick notice and reaction. In case of a stalling situation, it is in particular an objective to prevent the stalling situation from developing further with certain actions, which are efficient for ensuring safety. Embodiments are presented, inter alia, where the elevator can be arranged to work without a roping passing around a diverting wheel located in the lower parts of the hoistway.

It is brought forward a new elevator comprising a hoistway, a car and a counterweight vertically movable in the hoistway, and a rotatable drive member. The elevator further comprises one or more suspension ropes interconnecting the car and the counterweight and passing over the rotatable drive member. The elevator further comprises a drive machinery controlling rotation of the drive member, the drive machinery preferably comprising a brake for braking the drive member and a motor for rotating the drive member. The elevator further comprises a sensing means mounted on the counterweight and arranged to sense state of an elevator component. Said rope(s) comprise(s) electrically conducting member(s) extending continuously along the length of the rope(s) the electrically conducting member(s) forming an electrically conducting connection between the car and counterweight. Said sensing means are functionally connected with the drive machinery via said electrically conducting connection between the car and counterweight such that a predetermined state change sensed by the sensing means triggers the drive machinery to brake rotation of the drive member and/or to stop rotating the drive member. Hereby, a simple arrangement is provided, which can respond quickly to a state change of an elevator component. Thus, state of an elevator component which is connected to or part of the counterweight can be directly observed, and predetermined actions triggered without means of communication, which are in addition and separate of the essential elevator components. This is because the rope(s) interconnecting the car and counterweight are used to establish a portion of the functional connection between the sensing means and the drive machinery.

In a further refined embodiment, said a predetermined state change equals to reduction of rope tension below a certain limit. In this embodiment, each of the suspension rope(s) has a first rope section on the first side of the drive member and a second rope section on the second side of the drive member, the first section(s) of the rope(s) being connected to the car to suspend the car, and the second section(s) of the rope(s) being connected to the counterweight to suspend the counterweight. The aforementioned sensing means are in the form of rope tension sensing means mounted on the counterweight and arranged to sense tension of the second section(s) of the rope(s). The rope tension sensing means are functionally connected with the drive machinery via said electrically conducting connection between the car and counterweight such that reduced rope tension of the second rope section(s) sensed by the rope tension sensing means triggers the drive machinery to brake rotation of the drive member and/or to stop rotating the drive member. In this way, further development of a dangerous situation can be stopped and stalling situation avoided. Hereby a threatening situation is stopped from developing further with actions which are efficient for ensuring safety. Hereby, the elevator can safely be arranged to work without a roping passing around a diverting wheel located in the lower parts of the hoistway.

In a further refined embodiment, said rope(s) comprise(s) two of said electrically conducting members connected to each other by said sensing means, which are preferably tension sensing means as mentioned, and said electrically conducting members form consecutive parts of an electrical circuit between the car and counterweight. Thus, a simple and well working configuration is established. The electrical circuit is preferably under voltage. The electrical circuit can this configuration simply be arranged to be under voltage provided for by a source external to the counterweight. Preferably, said two electrically conducting members are parallel load bearing members of a same belt-shaped rope, and adjacent and spaced apart in the width direction of the rope.

In a further refined embodiment, each of said electrically conducting member(s) is embedded in polymer isolating the electrically conducting member from other electrically conducting member(s) of the rope. This polymer is preferably a coating forming also the surface of the rope.

In a further refined embodiment, each of said electrically conducting member(s) is a load bearing member of the rope in question. Thereby, there is no need for embedding conducting elements in the ropes, which do not contribute in the essential load bearing function of the rope. Particularly, it is preferable that the load bearing member is made of composite material comprising reinforcing fibers embedded in a polymer matrix, which reinforcing fibers are carbon fibers. With this material selection, the member can provide good properties in terms of load bearing and electrical conductivity. Then, it is preferable, that each of said at least one rope comprises a load bearing member or a plurality of load bearing members for bearing load in the longitudinal direction of the rope, which load bearing member(s) is/are made of composite material comprising reinforcing fibers embedded in a polymer matrix, which reinforcing fibers are carbon fibers, and in that each of said electrically conducting member(s) forming an electrically conducting connection between the car and counterweight is one of said load bearing members. Also, the ropes being of the carbon-fiber composite, they are light-weighted, and improve energy efficiency of the elevator. With this kind of ropes, the elevator is also particularly suitable for functioning without compensation ropes. Accordingly, it is preferable that the counterweight and the car are not interconnected with a compensation roping passing around a diverting wheel located in the lower parts of the hoistway. Thus, a safe and economical elevator configuration can be provided.

In a further refined embodiment, the elevator comprises a car unit mounted on the car, which car unit is electrically connected to the sensing means, which are preferably tension sensing means as mentioned, by said electrically conducting member(s). The sensing means are also electrically connected to the electrically conducting member(s) forming electrically conducting connection between the car and counterweight.

In a further refined embodiment, the elevator comprises a safety circuit breaking of which is arranged to cause the drive machinery to brake rotation of the drive member and/or to stop rotating the drive member, in particular to break power supply of the motor and/or the power supply of the brake actuator(s) keeping the brake(s) in released state when powered, and in that a predetermined state change sensed by the sensing means, such as said reduced rope tension of the second rope section(s) sensed by the rope tension sensing means, is arranged to trigger via the electrically conducting connection between the car and counterweight the car unit to break the safety circuit, and thereby to trigger said braking of the drive machinery and/or to stopping the rotating of the drive member. In a further refined embodiment, particularly the car unit mentioned above is arranged to break the safety circuit if a predetermined state change, such as said reduced rope tension of the second rope section(s), is sensed by the sensing means. For this purpose, the car unit preferably comprises a relay operating a safety switch of the safety circuit.

In a further refined embodiment, said sensing means comprise one or more rope tension sensors.

In a further refined embodiment, said two electrically conducting members extend parallelly. They are preferably comprised in the same rope, but they may alternatively be comprised in different ropes.

In a further refined embodiment, the sensing means, which are preferably tension sensing means as mentioned, are electrically connected to the electrically conducting member(s) forming said electrically conducting connection between the car and counterweight at a first end thereof, and the car unit is electrically connected to the electrically conducting member(s) forming said electrically conducting connection between the car and counterweight at the car at a second end thereof, and the electrically conducting member(s) continues unbroken between said first and second end.

In a further refined embodiment, the safety circuit extends between the car unit and the drive machinery.

In a further refined embodiment, the elevator comprises a traveling cable connected to the elevator car inside which the safety circuit passes.

In a further refined embodiment, each of said at least one rope is belt-like, whereby it is easy to embed several of said electrically conducting members in the rope spaced apart from each other.

In a further refined embodiment, the module of elasticity (E) of the polymer matrix is over 2 GPa, most preferably over 2.5 GPa, yet more preferably in the range 2.5-10 GPa, most preferably of all in the range 2.5-3.5 GPa. In this way a structure is achieved wherein the matrix essentially supports the reinforcing fibers, in particular from buckling. One advantage, among others, is a longer service life.

In a further refined embodiment, the load-bearing member(s) of the rope cover(s) over proportion 50% of the cross-section of the rope. Thereby, a high tensile stiffness can be facilitated.

In a further refined embodiment, the load-bearing member(s) of the rope cover(s) majority, preferably 60% or over, more preferably 65% or over of the width of the rope. In this way at least majority of the width of the rope will be effectively utilized and the rope can be formed to be light and thin in the bending direction for reducing the bending resistance.

In a further refined embodiment, the counterweight and the car are not interconnected with a compensation roping passing around a diverting wheel located in the lower parts of the hoistway. Thereby, the elevator is specifically sensitive to dangers related to slack rope and stalling. Safety of this kind of elevator can be increased with the rope tension sensing means as defined.

In a further refined embodiment, said load bearing member(s) is/are parallel with the longitudinal direction of the rope. Thereby, the load bearing members are oriented in the direction of the force when the rope is pulled, which increases the tensile stiffness and strength of the rope. Furthermore, it is preferred that said reinforcing fibers are parallel with the longitudinal direction of the load bearing member. In particular, the reinforcing fibers of the same load bearing member are preferably essentially untwisted in relation to each other. Thereby, the reinforcing fibers are oriented in the direction of the force when the load bearing member in question is pulled. This gives the load bearing members an excellent tensile stiffness and strength.

In a further refined embodiment, said rope(s) each comprise a plurality of parallel load bearing members adjacent and spaced apart in the width direction of the belt-shaped rope.

In a further refined embodiment, said load bearing member(s) is/are embedded in a common elastomeric coating of the rope in question. The ropes being belt-like, they provide a large surface area enabling efficient force transmission, e.g. by frictional engagement. This can be facilitated by elastomeric coating. In a preferred embodiment, the coating forms the surface of the rope.

In a further refined embodiment, individual reinforcing fibers are homogeneously distributed in said polymer matrix. Preferably, over 50% of the cross-sectional square area of the load-bearing part consists of said reinforcing fiber.

In a further refined embodiment, the counterweight does not comprise a battery or any other kind of power source mounted on it for providing power for the sensing means.

In further refined embodiment of a first type, each of said electrically conducting member(s) forms part of an electrical circuit between the car and counterweight breaking of which causes breaking of a safety circuit of the elevator, and the sensing means, which are preferably tension sensing means as mentioned, are configured to break the electrical circuit between the car and counterweight if a predetermined state change, e.g. reduced rope tension of the second rope section(s), is sensed by the sensing means. Preferably, the car unit is arranged to break the safety circuit if said circuit between the car and counterweight is broken. Preferably, said sensing means comprise a switch component configured to normally close the electrical circuit between the car and counterweight, which electrical circuit is formed at least partially by two electrically conducting members of the rope(s), and to open said electrical circuit in case of reduced rope tension of the second rope section(s). Preferably, the switch component is spring-actuated, rope tension being configured to work against the force of the spring(s), such that in case of reduced rope tension the spring force overcomes the rope tension and actuates the switch to move into open state.

In further refined embodiment of a second type, each said electrically conducting member(s) forms part of an electrical circuit between the car and counterweight, and the sensing means, which are preferably tension sensing means as mentioned, are configured to change an electrical property of the electrical circuit between the car and counterweight if a predetermined state change, e.g. said reduced rope tension of the second rope section(s), is sensed by the sensing means, and a predefined change in the electrical properties is configured to cause breaking of a safety circuit of the elevator. Preferably, the car unit is arranged to break the safety circuit if it detects a predefined change in the electrical properties of the electrical circuit between the car and counterweight. Preferably, said sensing means comprise one or more force sensors via which the rope(s) suspend(s) the counterweight, in particular via which the second section(s) of the rope(s) is/are fixed to the counterweight.

The elevator as described anywhere above is preferably, but not necessarily, installed inside a building. It is of the type where the elevator car is arranged to serve two or more landings. The car preferably responds to calls, such as destination calls from landing and/or destination commands from inside the car so as to serve persons on the landing(s) and/or inside the elevator car. Preferably, the car has an interior space suitable for receiving a passenger or passengers, and the car can be provided with a door for forming a closed interior space. Thereby, it is well suitable for serving passengers.

BRIEF DESCRIPTION OF THE DRAWINGS

In the following, the present invention will be described in more detail by way of example and with reference to the attached drawings, in which.

DETAILED DESCRIPTION

Figure 1:
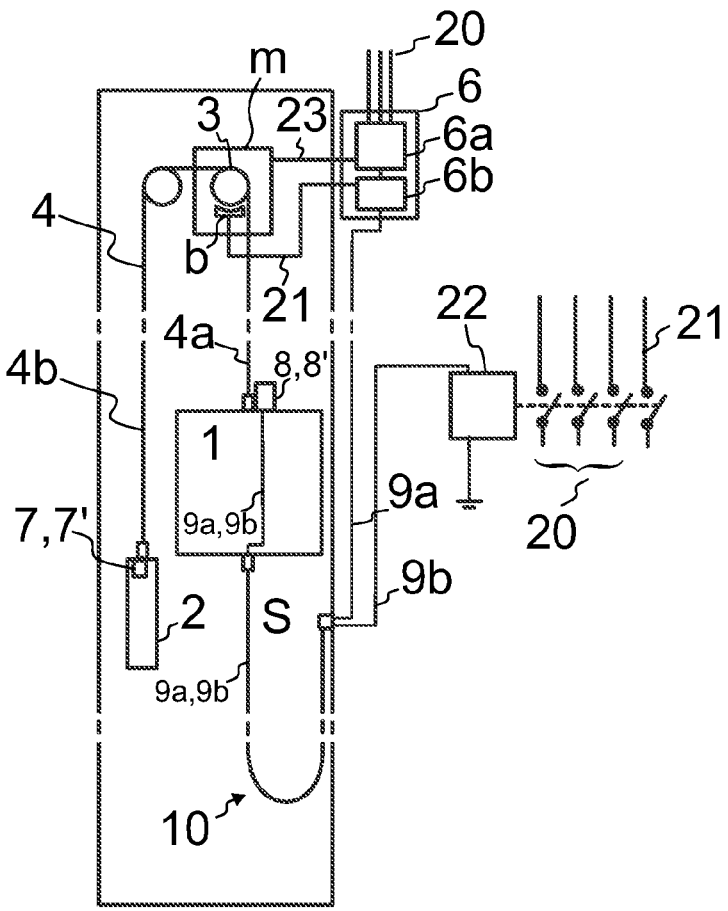
FIG. 1 illustrates schematically an elevator according to a preferred embodiment of the invention.

FIG. 1 illustrates an elevator according to a preferred embodiment. The elevator comprises a hoistway S, and a car 1 and a counterweight 2 vertically movable in the hoistway S. The elevator further comprises a rotatable drive member 3 and one or more suspension ropes 4 interconnecting the car 1 and counterweight 2 and passing over said rotatable drive member 3, which engages the rope(s) in a force transmitting manner. Each of the suspension rope(s) 4 has a first rope section 4*a* on the first side of the drive member 3 and a second rope section 4*b* on the second side of the drive member 3, the first section(s) 4*a* of the rope(s) 4 being connected to the car 1 to suspend the car 1, and the second section(s) 4*b* of the rope(s) 4 being connected to the counterweight 2 to suspend the counterweight 2. In this embodiment, the end of the second rope section 4*b* is fixed on the counterweight 2 and the end of the first rope section is fixed on the car 1.

The elevator further comprises a drive machinery b,m,6, 21,22 controlling rotation of the drive member 3. The drive machinery b,m,6,21,22 comprises one or more brakes b for braking the drive member 3 and a motor m for rotating the drive member 3. The drive machinery further comprises a control unit 6 connected with electrical connections 21,23 to the brake(s) b and the motor m via which connections it can control the brake(s) b and the motor m. Said electrical connection 23 is preferably electrical power supply for the motor m and said electrical connection 21 is preferably electrical power supply for the brake(s) b. The brake(s) are preferably mechanical brake(s). The brake(s) is/are preferably arranged to act on the drive member 3 during the braking by frictional engagement either directly or via a component connected to rotate with the drive member 3. The brake(s) is/are preferably so called machine brake(s). The drive machinery b,m,6,21,22 comprises an elevator control 6, which comprises a frequency converter 6*a* and a monitoring unit 6*b*.

The elevator further comprises a sensing means 7,7' mounted on the counterweight 2 and arranged to sense state of an elevator component 4*b*. The sensing means 7,7' are in this embodiment rope tension sensing means 7,7' mounted on the counterweight 2 arranged to sense tension of the second section(s) 4*b* of the rope(s) 4. Thereby, the system can notice a slack rope—situation on the counterweight side.

Slackening of ropes 4 on the counterweight side indicates that the force balance at the rotatable drive member 3 is unsafe. For enabling prevention of the situation getting more dangerous and even to stalling, such situation is reacted to by the drive machinery b,m,6,21,22. For enabling reacting to an unsafe situation, the sensing means 7,7' (in this case the rope tension sensing means 7,7') mounted on the counterweight 2 are connected with the drive machinery b,m,6,21,22 functionally such that a predetermined state change (in this case reduced rope tension, i.e. a rope tension which is below a certain limit, of the second rope section(s) 4*b* sensed by the rope tension sensing means 7,7'), triggers the drive machinery b,m,6,21,22 to brake rotation of the drive member 3 and/or to stop the rotating of the drive member 3. Said rope(s) 4 comprise electrically conducting members 5, each extending continuously along the length of the rope 4, the electrically conducting members 5 forming an electrically conducting connection between the car 1 and counterweight 2, via which electrically conducting connection said functional connection is established. In particular, the electrically conducting connection between the car 1 and counterweight 2 makes it possible that said functional connection is routed from counterweight 2 to the car 1 and further to the drive machinery b,m,6,21,22.

In the preferred embodiment, the rope tension sensing means 7,7' are electrically connected to said electrically conducting members 5. The elevator furthermore comprises a car unit 8,8' mounted on the car 1, which car unit 8,8' is electrically connected to the rope tension sensing means 7,7' by said electrically conducting members 5. FIGS. 4 (4*a* to 4*c*) and 5 (5*a* to 5*c*) illustrate alternative configurations for the elevator of FIG. 1. In both of these more detailed embodiments, the elevator furthermore comprises a safety circuit 9 (also referred to as a safety chain) breaking of which causes the drive machinery b,5,6,21,22 to brake rotation of the drive member 3 and/or to stop rotating the drive member 3. In particular, the breaking of the safety circuit 9 causes that power supply 20 to the frequency converter 6*a* is broken (the power supply 20 being thereby also a power supply of the motor m) and/or that the power supply 21 of the actuator(s) of the brake(s) b is broken, which actuator(s) keep(s) the brake(s) b normally in released state when powered. For this purpose the safety circuit 9 is connected to a contactor 22, which may be in the form of a relay, controlling switches of the power supply lines 20 and 21, as illustrated in the FIG. 1. Preferably, the safety circuit 9 is under voltage and the breaking thereof is arranged to cause the contactor 22 to release said switches to opened state and thereby to break the power supply of these power lines 20,21. Reduced rope tension of the second rope section(s) 4*b* sensed by the rope tension sensing means 7,7' is arranged to trigger via the electrically conducting connection between the car 1 and counterweight 2 the car unit 8,8' to break the safety circuit 9. In particular, the car unit 8,8' is arranged to break the safety circuit 9 if reduced rope tension of the second rope section(s) 4*b* is sensed by the rope tension sensing means 7,7'. For this purpose, it preferably comprises a relay 8*a*,8*a'* operating a safety switch s of the safety circuit. The relay 8*a*,8*a'* is preferably a normally closed—type relay (NC), for instance relay in the form of a SPSTNC—type relay. As illustrated in FIGS. 1 and 4*c* and 5*c*, in both of the embodiments, the safety circuit 9 connects the car unit 8,8' and the drive machinery. Thereby, said functional connection is established via said electrically conducting connection between the car (1) and counterweight (2), and further via the car unit 8,8', and the safety chain 9. As illustrated in FIGS. 1 and 4*c* and 5*c*, in both of the embodiments, on both sides of the safety switch s the safety chain has a conductor 9*a*,9*b* passing away from the car inside a traveling cable 10 connected to the elevator car 1.

Figure 2:
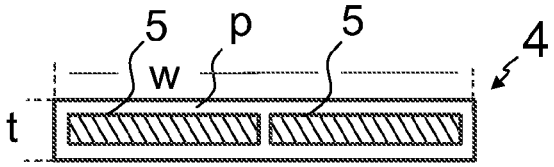
FIG. 2 illustrates schematically a rope of the elevator.
Figure 3:
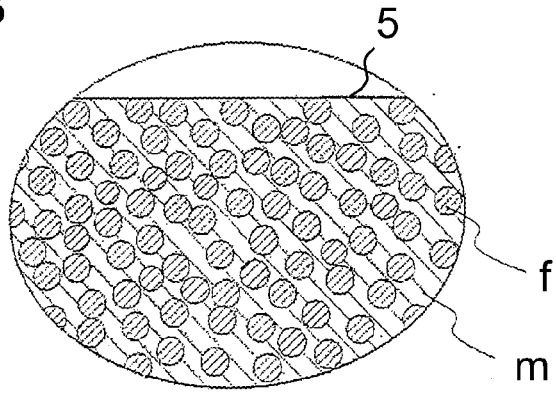
FIG. 3 illustrates an enlarged partial view of the cross section of a load bearing member of the rope.

FIGS. 2 and 3 illustrate a preferred structure for an individual rope 4. Each of the aforementioned electrically conducting members 5 is in this case a load bearing member 5 of a rope 4, which load bearing member 5 is made of composite material comprising reinforcing fibers f embedded in a polymer matrix m, which reinforcing fibers f are carbon fibers. With this material selection, the member 5 can provide good properties in terms of load bearing and electrical conductivity. Thereby, there is no need for embedding a conducting element in the rope 4, which does not contribute in the essential load bearing function of the rope 4. The aforementioned one or more ropes may comprise several of the ropes 4 as illustrated in FIGS. 2 and 3. It is not necessary that each of the ropes 4 has exactly two of the load bearing members 5 as disclosed in FIG. 2, but each rope 4 may have one or several of such load bearing members 5. Then, any two of the load bearing members 5 of the ropes 4, irrespective of whether they are comprised in the same rope 4 or in different ropes 4, can form a part of an electrical circuit which is formed between the counterweight 2 and the car 1. It is however preferable that there are at least two of such load bearing members 5 comprised in one rope which both form part of the aforementioned electrical circuit which is formed between the counterweight 2 and the car 1. In this way, the electrical connections are simple to provide, and the functional connection can be provided even with only one rope. For this purpose, it is advantageous that the ropes 4 are belt-like, as thereby it is easy to embed several of said electrically conducting/load bearing members 5 in one rope 4 to be spaced apart from each other in width direction of the rope 4. Several other alternatives for the structure of the rope 4 are illustrated and described in document WO2009090299A1.

As illustrated in FIGS. 2 and 3, the electrically conducting members 5 forming the electrically conducting connection between the car 1 and counterweight 2, each of which is in this case a load bearing member 5 of a rope 4, are embedded in polymer coating p immediately against and surrounding the electrically conducting member 5, which polymer coating p isolates each electrically conducting member 5 from any other electrically conducting member of the rope 4 as well as from components external to the rope 4 with which component the conducting member 4 could otherwise get into contact. The coating p is preferably of polymer, most preferably of elastic polymer, such as of polyurethane, as it provides good wear resistance, protection and good friction properties, for instance for frictional traction contact with the rotatable drive member 3. The coating p forms in these embodiments the surface of the rope.

As mentioned, rope 4 is preferably in the form of a belt, and thereby has a width w substantially larger than the thickness t thereof as presented in FIG. 2. This makes it well suitable for elevator use as bending of the rope is necessary in most elevators. So as to give a turning radius well suitable for elevator use, it is preferable that the width/thickness ratio of the rope is at least 2 or more, preferably at least 4, even more preferably at least 5 or more. Furthermore, so as to give a turning radius well suitable for elevator use, it is preferable that the width/thickness ratio(s) of said load bearing member(s) 5 is/are at least 2, preferably at least 3 or more. If the rope 4 is made to contain only one load bearing member 5, then it is preferable that this ratio is 5 or more. It is preferable, that all the load bearing member(s) 5 of the rope (irrespective whether there is only one or more of them in the rope) cover together majority, preferably 70% or over, more preferably 75% or over, most preferably 80% or over, of the width of the rope. Thus, the width of the rope is effectively utilized for the function of load bearing.

The preferred composite structure of the load bearing member 5 is preferably more specifically as follows. The load bearing member 5, as well as its fibers f are parallel with the longitudinal direction the rope, and untwisted as far as possible. Individual reinforcing fibers f are bound into a uniform load bearing member with the polymer matrix m. Thus, each load bearing member 5 is one solid elongated rodlike piece. The reinforcing fibers f are preferably long continuous fibers in the longitudinal direction of the rope 4, the fibers f preferably continuing for the whole length of the load bearing member 5 as well as the rope 4. Preferably as many fibers f as possible, most preferably substantially all the fibers f of the load bearing member 5 are oriented parallel with the rope, as far as possible in untwisted manner in relation to each other. Thus the structure of the load bearing member 5 can be made to continue the same as far as possible in terms of its cross-section for the whole length of the rope. The reinforcing fibers f are preferably distributed in the aforementioned load bearing member 5 as evenly as possible, so that the load bearing member 5 would be as homogeneous as possible in the transverse direction of the rope. An advantage of the structure presented is that the matrix m surrounding the reinforcing fibers f keeps the interpositioning of the reinforcing fibers f substantially unchanged. It equalizes with its slight elasticity the distribution of a force exerted on the fibers, reduces fiber-fiber contacts and internal wear of the rope, thus improving the service life of the rope. The composite matrix m, into which the individual fibers f are distributed as evenly as possible, is most preferably of epoxy resin, which has good adhesiveness to the reinforcement fibers f and which is known to behave advantageously with carbon fiber. Alternatively, e.g. polyester or vinyl ester can be used, but alternatively any other suitable alternative materials can be used. FIG. 3 presents a partial cross-section of the load bearing member 5 close to the surface thereof as viewed in the longitudinal direction of the rope presented inside the circle in the figure, according to which cross-section the reinforcing fibers f of each load bearing member 5 are preferably organized in the polymer matrix m. The rest (not showed parts) of the load bearing member 5 has a similar structure. FIG. 3 presents also how the individual reinforcing fibers f are substantially evenly distributed in the polymer matrix m, which surrounds the fibers and which is fixed to the fibers f. The polymer matrix m fills the areas between individual reinforcing fibers f and binds substantially all the reinforcing fibers f that are inside the matrix m to each other as a uniform solid substance. A chemical bond exists between, preferably all, the individual reinforcing fibers f and the matrix m, one advantage of which is uniformity of the structure. To strengthen the chemical bond, there can be, but not necessarily, a coating (not presented) of the actual fibers between the reinforcing fibers and the polymer matrix m. The polymer matrix m is preferably of a hard non-elastomer. It can comprise additives for fine-tuning the properties of the matrix as an addition to the base polymer. The reinforcing fibers f being in the polymer matrix means here that the individual reinforcing fibers are bound to each other with the polymer matrix m, e.g. in the manufacturing phase by immersing them together in the fluid material of the polymer matrix. In this case the gaps of individual reinforcing fibers bound to each other with the polymer matrix comprise the polymer of the matrix. In this way a great number of reinforcing fibers bound to each other in the longitudinal direction of the rope are distributed in the polymer matrix. The reinforcing fibers are preferably distributed substantially evenly in the polymer matrix such that the load bearing member is as homogeneous as possible when viewed in the direction of the cross-section of the rope. In other words, the fiber density in the cross-section of the load bearing member does not therefore vary substantially. The reinforcing fibers f together with the matrix m form a uniform load bearing member, inside which abrasive relative movement does not occur when the rope is bent. The individual reinforcing fibers of the load bearing member 5 are mainly surrounded with polymer matrix m, but random fiber-fiber contacts can occur because controlling the position of the fibers in relation to each other in their simultaneous impregnation with polymer is difficult, and on the other hand, perfect elimination of random fiber-fiber contacts is not necessary from the viewpoint of the functioning of the invention. If, however, it is desired to reduce their random occurrence, the individual reinforcing fibers f can be pre-coated such that a polymer coating is around them already before the binding of individual reinforcing fibers to each other. In the invention the individual reinforcing fibers of the load bearing member can comprise material of the polymer matrix around them such that the polymer matrix is immediately against the reinforcing fiber but alternatively a thin coating, e.g. a primer arranged on the surface of the reinforcing fiber in the manufacturing phase to improve chemical adhesion to the matrix material, can be in between. Individual reinforcing fibers are distributed evenly in the load bearing member 5 such that the gaps of individual reinforcing fibers f are filled with the polymer of the matrix m. Most preferably the majority, preferably substantially all of the gaps of the individual reinforcing fibers f in the load bearing member 5 are filled with the polymer of the matrix m. As above mentioned, the matrix m of the load bearing member 5 is most preferably hard in its material properties. A hard matrix m helps to support the reinforcing fibers f, especially when the rope bends, preventing buckling of the reinforcing fibers f of the bent rope, because the hard material supports the fibers f. To reduce the buckling and to facilitate a small bending radius of the rope, among other things, it is therefore preferred that the polymer matrix is hard, and in particular non-elastomeric. The most preferred materials are epoxy resin, polyester, phenolic plastic or vinyl ester. The polymer matrix is preferably so hard that its module of elasticity (E) is over 2 GPa, most preferably over 2.5 GPa. In this case the module of elasticity (E) is preferably in the range 2.5-10 GPa, most preferably in the range 2.5-3.5 GPa. There are commercially available various material alternatives for the matrix m which can provide these material properties. Preferably over 50% of the surface area of the cross-section of the load bearing member 5 is of the aforementioned reinforcing fiber, preferably such that 50%-80% is of the aforementioned reinforcing fiber, more preferably such that 55%-70% is of the aforementioned reinforcing fiber, and substantially all the remaining surface area is of polymer matrix. Most preferably, this is carried out such that approx. 60% of the surface area is of reinforcing fiber and approx. 40% is of matrix material (preferably epoxy material). In this way a good longitudinal stiffness for the load bearing member 5 as well as good electrical conductivity are achieved.

Figure 4A:
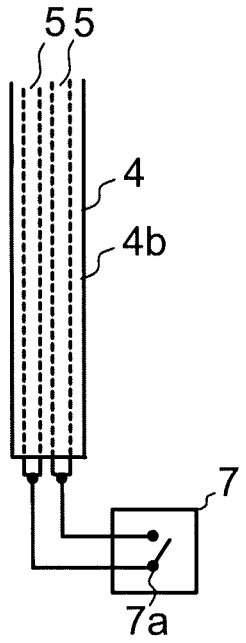
FIGS. 4*a* to 4*c* illustrate further preferred details for the elevator of FIG. 1 according to a first alternative.
Figure 4B:
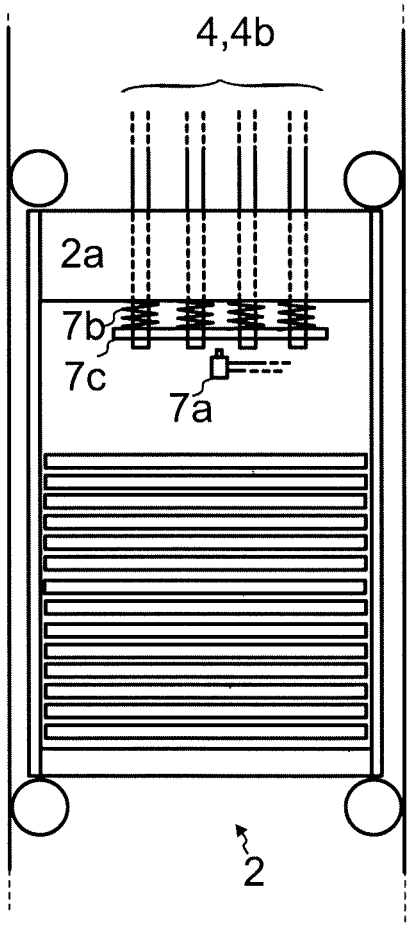
Figure 4C:
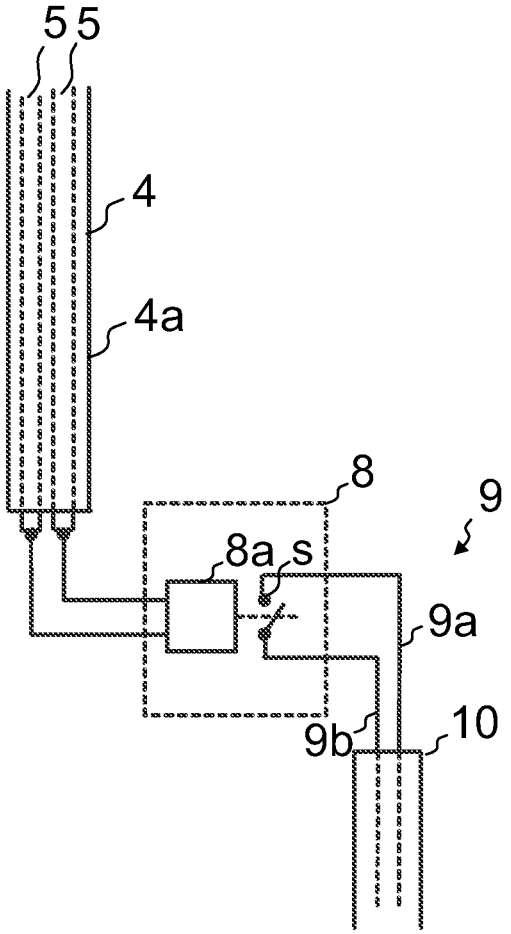

FIGS. 4 (4*a* to 4*c*) and 5 (5*a* to 5*c*) illustrate alternative configurations for the elevator of FIG. 1. FIGS. 4*a* to 4*c* illustrate a configuration where each of said electrically conducting members 5 forms part of an electrical circuit breaking of which causes breaking of a safety circuit 9 of the elevator, and the rope tension sensing means 7 are configured to break the electrical circuit between the car 1 and counterweight 2 if reduced rope tension of the second rope section(s) 4*b* is sensed by the rope tension sensing means 7. For this purpose, the sensing means 7 comprise a switch component 7*a* configured to normally close the electrical circuit between the car 1 and counterweight 2 formed at least partially by two electrically conducting members 5 of the ropes (in this case by two conducting members 5 of one and the same rope 4 and to open said electrical circuit in case of reduced rope tension of the second rope section(s) 4*b*. It is preferable that the electrical circuit is under voltage when it is closed. If said electrical circuit between the car 1 and counterweight 2 is broken the car unit 8 is arranged to break the safety circuit 9. Thus, educed rope tension of the second rope section(s) 4*b* sensed by the rope tension sensing means 7 is arranged to break said conducting connection between the car 1 and counterweight 2 and thereby trigger via the electrically conducting connection between the car 1 and counterweight 2 the car unit 8,8' to break the safety circuit 9 and thereby to trigger said braking of the drive machinery (b,5,6,21,22) and/or to stopping the rotating of the drive member (3). The switch component 7*a* is preferably spring-actuated, the rope tension working against the force of the spring(s) 7*c*, and configured such that in case of reduced rope tension the spring force overcomes the rope tension and actuates the switch to move into open state. As illustrated in FIG. 4*b* the ropes are mounted via said springs 7*b*. In particular, said springs 7*b* are mounted between the hitch plate 7*c* and the counterweight frame 2*a* to urge the hitch plate towards the tension sensor 7*a*. In case the tension of the second rope sections 4*b* drops, the spring force overcomes the rope tension force and moves the hitch plate 7*c* against the tension sensor 7*a*, which then is brakes the electrical circuit between the car (1) and counterweight (2) formed at least partially by two electrically conducting members (5). The car unit 8, in particular a relay 8*a* thereof opens a safety switch s of the safety chain 9 in response to breaking of the electrical circuit between the car (1) and counterweight (2) formed at least partially by two electrically conducting members (5, which has the consequence that the power supply 20 to the frequency converter 6*a* to break and/or the power supply 21 of the actuator(s) of the brake(s) b to break.

Figure 5A:
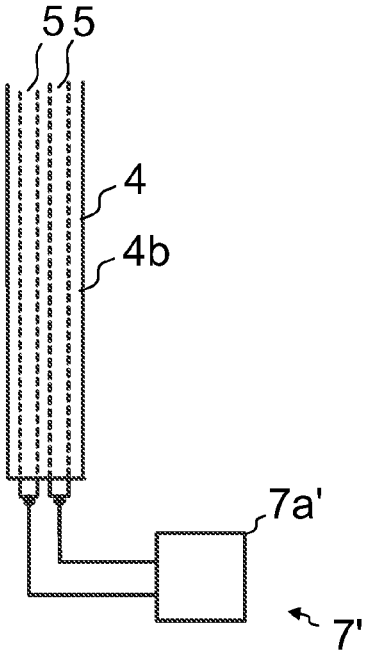
FIGS. 5*a* to 5*c* illustrate further preferred details for the elevator of FIG. 1 according to a second alternative.
Figure 5B:
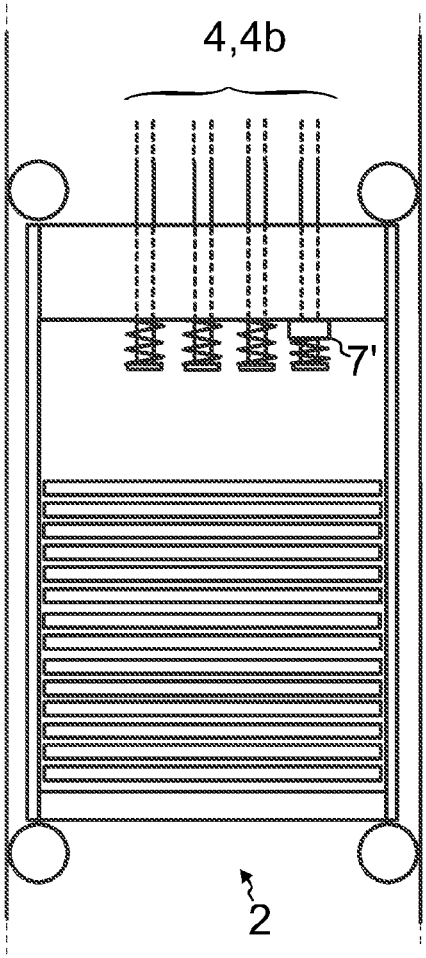
Figure 5C:
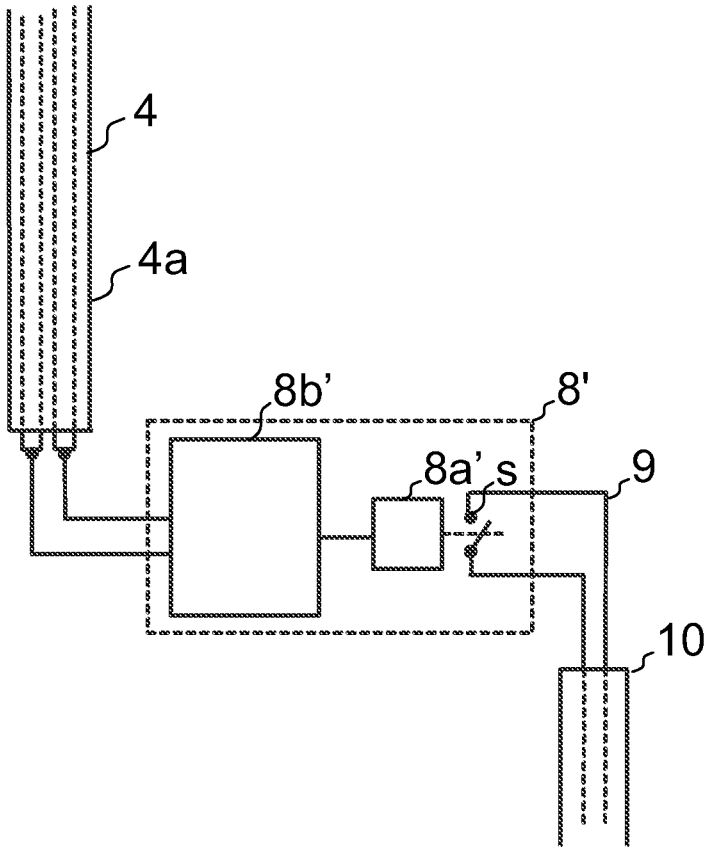

FIGS. 5*a* to 5*c* illustrate a configuration where each said electrically conducting member(s) 5 forming said electrically conducting connection between the car (1) and counterweight 2 forms part of an electrical circuit between the car 1 and counterweight 2, and the rope tension sensing means 7' are configured to change an electrical property of the circuit between the car 1 and counterweight 2 if reduced rope tension of the second rope section(s) 4*b* is sensed by the rope tension sensing means 7', and a predefined change in the electrical properties is configured to cause breaking of a safety circuit 9 of the elevator. In particular, the car unit 8' is arranged to break the safety circuit (9) if it detects a predefined change in the electrical properties of the electrical circuit between the car 1 and counterweight 2. Said sensing means 7' comprise one or more rope tension sensors 7*a*' configured to change the electrical properties of the circuit when the sensor(s) sense reduced rope tension. In this embodiment, the sensor(s) 7*a*' is/are force sensor(s) 7*a*' via which the rope(s) (4) suspend(s) the counterweight, in particular via which the second section(s) of the rope(s) is/are fixed to the counterweight. Thereby, the rope tension is transmitted to the force sensor(s) 7*a*'. Said change in the electrical properties may be for instance a change in resistance caused by change in force directed to the force sensor(s) 7*a*'. There may be one or more of the force sensor(s) 7*a*', for example sensing different ropes 4. In the example as illustrated in FIGS. 5*a* to 5*c* there is only on sensor 7*a*' and one of said electrical circuits between the car 1 and counterweight 2. Said sensor 7*a*' is preferably in the form a strain gauge. It is preferable that the electrical circuit is under voltage. For the purpose of detecting the change in the electrical property of the circuit at the car end, the car unit 8' comprises a monitoring unit 8*b*' controlling a safety relay 8*a*'. The car unit 8', in particular the monitoring unit 8*b*' is configured to control said relay 8*a*' to open a safety switch s of the safety chain 9 in response to the detected change in the electrical property of the electrical circuit at the car end, which has the consequence that the power supply 20 to the frequency converter 6*a* to break and/or the power supply 21 of the actuator(s) of the brake(s) b to break.

In this application, the term load bearing member of a rope refers to the part that is elongated in the longitudinal direction of the rope, and which part is able to bear without breaking a significant part of the load exerted on the rope in question in the longitudinal direction of the rope. The aforementioned load exerted on the rope causes tension on the load bearing member in the longitudinal direction of the load bearing member, which tension can be transmitted inside the load bearing member in question all the length of the load bearing member, e.g. from one end of the load bearing member to the other end of it.

In the application said reduced rope tension is considered to mean a rope tension, which is below a certain limit. Said limit is preferably predetermined substantially below a rope tension which is considered to be within normal variation of the rope tension of the second rope section(s) being sensed.

In the examples presented in the application, the elevator comprises two of said electrically conducting members forming an electrically conducting connection between the car and counterweight, which are connected to each other by said tension sensing means, and forming consecutive parts of an electrical circuit between the car and counterweight. This is a preferred configuration, but some aspects of the configuration can be changed if desired. In particular, the number of said electrically conducting members could be greater or smaller. It is even possible to realize an electrically conducting connection functioning as described with only one of said electrically conducting members. In this case, the tension sensing means is preferable to equip with a battery for providing voltage, which is then utilized for sending an electrical signal to the drive machinery via the connection between the car and the counterweight so as to trigger the functions defined elsewhere in the application.

As more specifically described and illustrated earlier with examples, a predetermined state change sensed by the sensing means is arranged to trigger via said electrically conducting connection the drive machinery to brake rotation of the drive member and/or to stop rotating the drive member. In the preferred embodiment of this idea, reduced rope tension of the second rope section(s) 4*b* sensed by the rope tension sensing means 7,7' is arranged to trigger via said electrically conducting connection the drive machinery b,5, 6,21,22 to brake rotation of the drive member 3 and/or to stop rotating the drive member 3. In the preferred embodiment, said sensing means 7,7' mounted on the counterweight 2 and arranged to sense state of an elevator component 4*b* are in the form of a rope tension sensing means 7,7' mounted on the counterweight 2 and arranged to sense tension of the second section(s) 4*b* of the rope(s) 4, said predetermined state change being a reduced rope tension, i.e. the predetermined state change equals to reduction of rope tension below a certain limit. However, said sensing means 7,7' may be alternatively arranged to sense state of a different component than the second section(s) 4*b* of the rope(s), for example state of a brake acting on guide rails of the counterweight, the brake being in particular a safety gear, mounted on the counterweight 2. Thus, actuation of the brake is quickly noticed and reacted to. In another example of such different component the state of which is sensed; the component may be the guide rail of the counterweight 2 or a component which is dependent of counterweights 2 position relative to its guide rails, whereby (direct or indirect) sensing of counterweight derailment can be provided. Thus, derailment is quickly noticed and reacted to.

It is to be understood that the above description and the accompanying Figures are only intended to illustrate the present invention. It will be apparent to a person skilled in the art that the inventive concept can be implemented in various ways. The invention and its embodiments are not limited to the examples described above but may vary within the scope of the claims.

The invention claimed is:

1. An elevator comprising:

a car;

a counterweight;

a rotatable drive member;

one or more suspension ropes interconnecting the car and the counterweight and passing over the rotatable drive member;

a drive machinery for controlling rotation of the drive member;

a sensor mounted on the counterweight and arranged to sense a state of an elevator component, a hitch plate connected to the one or more suspension ropes; and at least one spring mounted to said hitch plate and a counterweight frame, such that the at least spring is located between the hitch plate and the counterweight frame, wherein each of said one or more suspension ropes comprise at least one electrically conducting member extending continuously along the length of the rope forming an electrically conducting connection between the car and counterweight, wherein the sensor is functionally connected with the drive machinery via said electrically conducting connection between the car and counterweight such that a predetermined state change sensed by the sensor triggers the drive machinery to brake rotation of the drive member and/or to stop rotating the drive member, and wherein the sensor is provided adjacent to the hitch plate.

2. The elevator according to claim 1, wherein:

each suspension rope has a first rope section on a first side of the drive member and a second rope section on a second side of the drive member, the first section being connected to the car to suspend the car, and the second section being connected to the counterweight to suspend the counterweight;

the sensor is a rope tension sensor mounted on the counterweight and arranged to sense tension of the second section; and the rope tension sensor is functionally connected with the drive machinery via said electrically conducting connection between the car and counterweight such that a reduced rope tension of the second rope section sensed by the rope tension sensor triggers the drive machinery to brake rotation of the drive member and/or to stop rotating the drive member.

3. The elevator according to claim 2, wherein each electrically conducting member is embedded in a polymer isolating the electrically conducting member from other electrically conducting members of the rope.

4. The elevator according to claim 2, wherein each electrically conducting member is a load bearing member, which load bearing member is made of composite material comprising reinforcing fibers embedded in a polymer matrix, which reinforcing fibers are carbon fibers.

5. The elevator according to claim 2, wherein the elevator comprises a car unit mounted on the car, which car unit is electrically connected to the sensor by said at least one electrically conducting member.

6. The elevator according to claim 1, wherein each electrically conducting member is embedded in a polymer isolating the electrically conducting member from other electrically conducting members of the rope.

7. The elevator according to claim 6, wherein each electrically conducting member is a load bearing member of the rope in question, which load bearing member is made of composite material comprising reinforcing fibers embedded in a polymer matrix, which reinforcing fibers are carbon fibers.

8. The elevator according to claim 1, wherein each electrically conducting member is a load bearing member, which load bearing member is made of composite material comprising reinforcing fibers embedded in a polymer matrix, which reinforcing fibers are carbon fibers.

9. The elevator according to claim 1, wherein the elevator comprises a car unit mounted on the car, which car unit is electrically connected to the sensor by said at least one electrically conducting member.

10. The elevator according to claim 1, wherein:

the elevator comprises a safety circuit, breaking of which is arranged to cause the drive machinery to brake rotation of the drive member and/or to stop rotating the drive member; and a predetermined state change sensed by the sensor is arranged to trigger via the electrically conducting connection between the car and the counterweight to break the safety circuit, and thereby to trigger the drive machinery to brake rotation of the drive member and/or to stop rotating the drive member.

11. The elevator according to claim 1, wherein each of said one or more suspension ropes comprise two electrically conducting members connected to each other by said sensor, said two electrically conducting members forming consecutive parts of an electrical circuit between the car and counterweight.

12. The elevator according to claim 1, wherein each electrically conducting member forms part of an electrical circuit breaking of which causes breaking of a safety circuit of the elevator, and the sensor is configured to break the electrical circuit between the car and counterweight if a predetermined state change is sensed by the sensor.

13. The elevator according to claim 1, wherein each electrically conducting member forms part of an electrical circuit between the car and counterweight, and the sensor is configured to break the electrical circuit between the car and counterweight if a predetermined state change is sensed by the sensor, and the car is arranged to break the safety circuit if said electrical circuit between the car and counterweight is broken.

14. The elevator according to claim 1, wherein said sensor comprises one or more rope tension sensors.

15. The elevator according to claim 1, wherein each electrically conducting member forms part of an electrical circuit between the car and counterweight, and the sensor is configured to change an electrical property of the electrical circuit between the car and counterweight if predetermined state change is sensed by the sensor, and a predefined change in said electrical properties is configured to cause breaking of a safety circuit of the elevator.

16. The elevator according to claim 1, wherein each said electrically conducting member forms part of an electrical circuit between the car and counterweight, and the sensor is configured to change an electrical property of the electrical circuit between the car and counterweight if a predetermined state change is sensed by the sensor, and the car unit is arranged to break the safety circuit if it detects a predefined change in the electrical properties of the circuit between the car and counterweight.

17. The elevator according to claim 1, wherein said sensor comprises one or more force sensors via which the one or more suspension ropes suspend the counterweight.

18. The elevator according to claim 1, wherein the elevator comprises a traveling cable connected to the elevator car inside which traveling cable a safety circuit passes.

19. The elevator according to claim 1, wherein said one or more suspension ropes are belt-shaped.

20. The elevator according to claim 1, wherein said sensor comprises one or more force sensors via which the one or more suspension ropes suspend the counterweight, via which the second section of each rope is fixed to the counterweight.

* * * * *